US010234234B2

(12) United States Patent
Cornwell

(10) Patent No.: US 10,234,234 B2
(45) Date of Patent: Mar. 19, 2019

(54) FIREARM RECOIL SYSTEM

(71) Applicant: Gary Raymond Cornwell, Melbourne, FL (US)

(72) Inventor: Gary Raymond Cornwell, Melbourne, FL (US)

( * ) Notice: Subject to any disclaimer, the term of this patent is extended or adjusted under 35 U.S.C. 154(b) by 0 days.

(21) Appl. No.: 15/907,283

(22) Filed: Feb. 27, 2018

(65) Prior Publication Data

US 2018/0245878 A1 Aug. 30, 2018

Related U.S. Application Data

(60) Provisional application No. 62/464,230, filed on Feb. 27, 2017.

(51) Int. Cl.

| | |
|---|---|
| ***F41A 3/86*** | (2006.01) |
| ***F41C 27/22*** | (2006.01) |
| ***F41A 5/02*** | (2006.01) |
| ***F41C 23/06*** | (2006.01) |
| ***F41A 3/56*** | (2006.01) |
| *F41C 3/00* | (2006.01) |

(52) U.S. Cl.

CPC ..... *F41C 27/22* (2013.01); *F41A 3/56* (2013.01); *F41A 5/02* (2013.01); *F41C 23/06* (2013.01); *F41C 3/00* (2013.01)

(58) Field of Classification Search

CPC ..... F41A 3/44; F41A 3/46; F41A 3/56; F41A 5/02; F41C 3/00; F41C 27/22

See application file for complete search history.

(56) References Cited

U.S. PATENT DOCUMENTS

| | | | | |
|---|---|---|---|---|
| 3,491,650 | A * | 1/1970 | Rohr | F41A 3/78 42/7 |
| 4,127,056 | A * | 11/1978 | Kart | F41A 21/484 42/75.02 |
| 6,212,991 | B1 * | 4/2001 | Frazier, III | F41A 3/82 42/16 |
| 6,761,102 | B2 * | 7/2004 | Giza | F41A 3/54 89/161 |
| 8,286,541 | B2 * | 10/2012 | Lorenzut | F41A 5/12 89/189 |
| 2006/0260461 | A1 * | 11/2006 | Rozhkov | F41A 3/56 89/194 |
| 2006/0266209 | A1 * | 11/2006 | Grabowski | F41A 3/86 89/198 |

FOREIGN PATENT DOCUMENTS

| | | | | |
|---|---|---|---|---|
| DE | 19951536 | C1 * | 7/2001 | F41C 27/22 |

* cited by examiner

*Primary Examiner* — Gabriel J. Klein

(57) ABSTRACT

A firearm recoil system replaces a traditional slide of a fire arm to mitigate the recoil from the discharging an automatic firearm. The firearm recoil system includes a firearm, a first slide weight, a second slide weight, and a recoil transfer actuator. The first slide weight and the second slide weight are slideably engaged with a frame of the firearm. The first slide weight is slotted over a barrel of the firearm. The second slide weight is slotted over a bolt carrier of the firearm. As an ammunition round is ignited, the bolt is depressed causing the recoil transfer actuator to be displaced and redirects the force of the recoil into the first slide weight and the second slide weight. The first slide weight and the second slide weight translate away from the recoil transfer actuator to compensate for the recoil of the firearm.

11 Claims, 5 Drawing Sheets

FIREARM RECOIL SYSTEM

The current application claims a priority to the U.S. Provisional Patent application Ser. No. 62/464,230 filed on Feb. 27, 2017.

FIELD OF THE INVENTION

The present invention relates generally to an apparatus for an automatic firearm. More specifically, the present invention is an apparatus pertaining to the recoil of the firearm. The apparatus is for use in all guns that require recoil to recharge the gun with a new bullet.

BACKGROUND OF THE INVENTION

Traditionally, the user of a firearm compensates for the recoil from discharging ammunition by utilizing the user's body. The user counters the momentum from the discharged ammunition by applying an opposite force to the recoil. As mentioned, the recoil is generated by the counter force from discharging the firearm. The recoil force is transferred through the bolt to the grip or stock of the firearm and to the user. The recoil force, if improperly compensated, has the potential to injure the user.

It is therefore an object of the present invention to have the kinetic energy from the recoil dispersed to key components and using counter weights to counter act the recoil spring. As the bolt is depressed towards the rear of the firearm from the discharge of ammunition, a recoil transfer actuator redirects the recoil force to a first slide weight and a second slide weight. The first slide weight and the second slide weight translate oppositely along the central axis of the barrel to compensate for the recoil. With the present invention, an automatic firearm would be able to be discharged with minimal recoil.

DETAIL DESCRIPTIONS OF THE INVENTION

All illustrations of the drawings are for the purpose of describing selected versions of the present invention and are not intended to limit the scope of the present invention.

The present invention is a firearm recoil system. The present invention is a replacement for a traditional slide of a firearm to compensate for or eliminates the recoil from the discharging an automatic or semi-automatic firearm. The present invention utilizes the pressure generated from the discharge of ammunition to actuate the recoil compensation.

Figure 1:
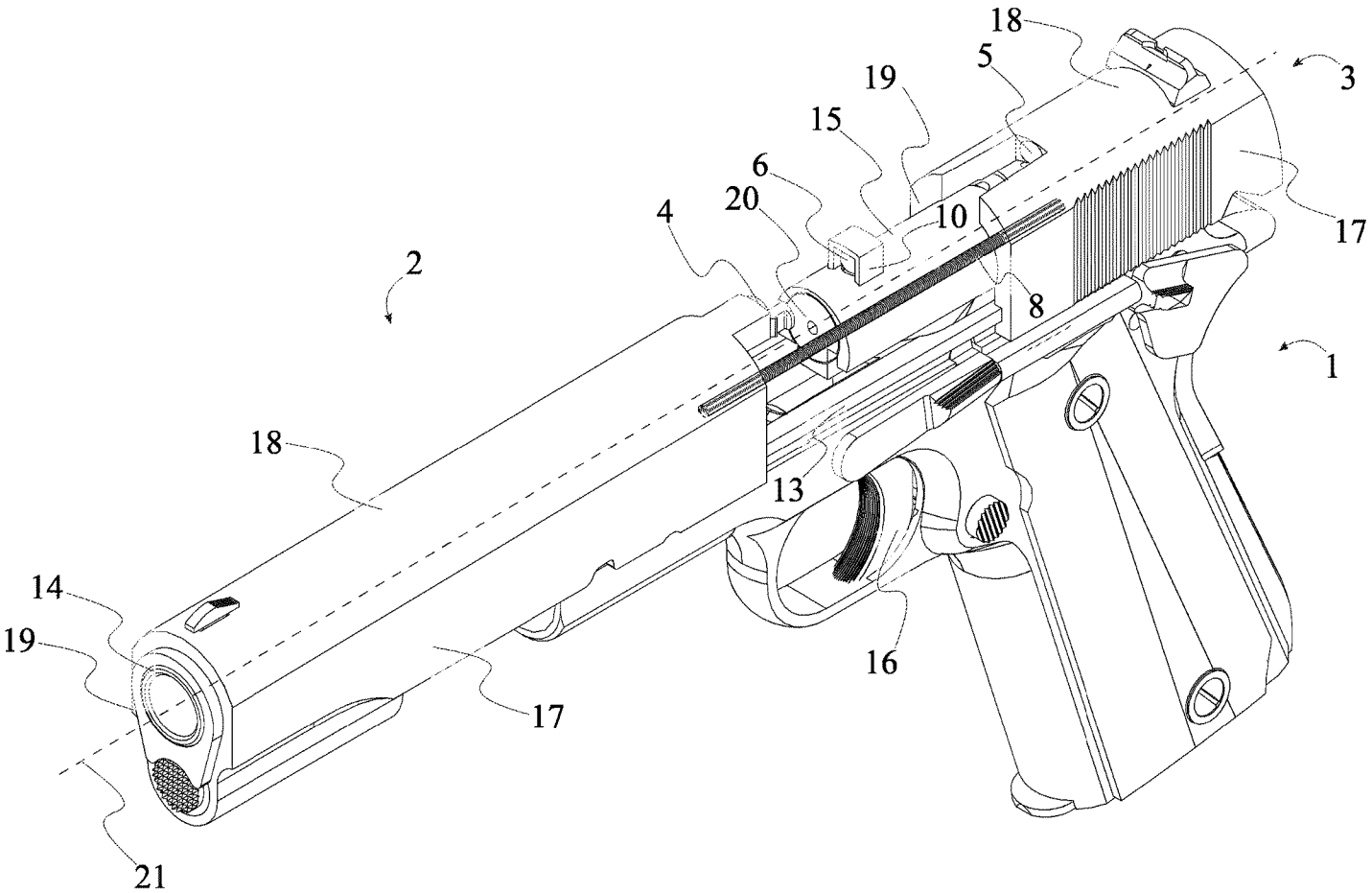
FIG. 1 is a perspective view of the present invention, wherein the present invention is in the fired configuration.

In accordance to FIG. 1, the present invention comprises a firearm 1, a first slide weight 2, a second slide weight 3, a first recoil contact 4, a second recoil contact 5, a recoil transfer actuator 6, an actuation groove 7. The firearm 1 is a portable gun that ignites ammunition to discharge a projectile using high pressure from exothermic combustion of a propellant. The first slide weight 2 and the second slide weight 3 compensate for the recoil. The first slide weight 2 slideably engages the frame 13 of the firearm 1 to allow the momentum from the recoil to be compensated by the first slide weight 2 sliding towards a discharge end of the barrel 14. The first slide weight 2 is preferred to be slideably engaged with the frame 13 along a central axis 21 of the barrel 14 to compensate for the recoil effectively. The first slide weight 2 is slotted over a barrel 14 of the firearm 1. Similarly, the second slide weight 3 slideably engages the frame 13 to allow the momentum from the recoil to be absorbed by the first slide weight 2. The second slide weight 3 is also preferred to be slideably engaged with the frame 13 along the central axis 21 to compensate for the recoil effectively. The second slide weight 3 is slotted over a bolt carrier 15 of the firearm 1. The first recoil contact 4 and the second recoil contact 5 redirects the force from the recoil transfer actuator 6 to the first slide weight 2 and the second slide weight 3, respectively. The first recoil contact 4 is adjacently connected to the first slide weight 2. Similarly, the second slide weight 3 is adjacently connected to the second slide weight 3. The recoil transfer actuator 6 redirects the force of the recoil from a bolt 20 of the firearm 1 to the first recoil contact 4 and the second recoil contact 5. The actuation groove 7, shown in FIG. 4 receives the recoil transfer actuator 6. The actuation groove 7 traverses into a bolt 20 of the bolt carrier 15. The actuation groove 7 is diametrically opposed with a trigger 16 of the firearm 1, about the bolt 20. As the bolt 20 is depressed, the recoil transfer actuator 6 is raised onto the bolt 20 as the actuation groove 7 translates past the recoil transfer actuator 6. The recoil transfer actuator 6 is selectively seated within the actuation groove 7. In this configuration, the recoil transfer actuator 6 is forced out from the bolt 20 as the bolt 20 is depressed from the pressure generated from igniting the ammunition. The recoil transfer actuator 6 is positioned between the first recoil contact 4 and the second recoil contact 5, such that as the recoil transfer actuator 6 is forced out from the bolt 20, the recoil transfer actuator 6 impacts the first recoil contact 4 and the second recoil contact 5.

In accordance to the preferred embodiment of the present invention, the present invention comprises a first compression spring 8, detailed in FIG. 1. The first compression spring 8 is utilized to reset the first slide weight 2 and the second slide weight 3 into a pre-fired configuration, shown in FIG. 2 to FIG. 4. The first compression spring 8 is terminally connected to the first slide weight 2. The first compression spring 8 is terminally connected to the second slide weight 3. The first slide weight 2 is oppositely positioned with the second slide weight 3 along the first compression spring 8. This configuration allows the for the expansion of the first compression spring 8 after the ammunition is discharged to create an opening for a spent cartridge to be ejected from the present invention as the first slide weight 2 and the second slide weight 3 contract towards each other. When the first compression spring 8 is approximately halfway through contracting the first slide weight 2 and the second slide weight 3, the spent cartridge contacts an ejector pin to dislodge the ammunition casing out from the present invention. Once the ammunition casing is dislodged from the present invention, an ammunition round is drawn from a magazine of the firearm 1 into the barrel 14 to ready the ammunition round to be discharged. The first compression spring 8 is circumferentially offset from the ejector pin, such that the spent cartridge does not impact the first compression spring 8 as the spent cartridge is ejected.

Figure 4:
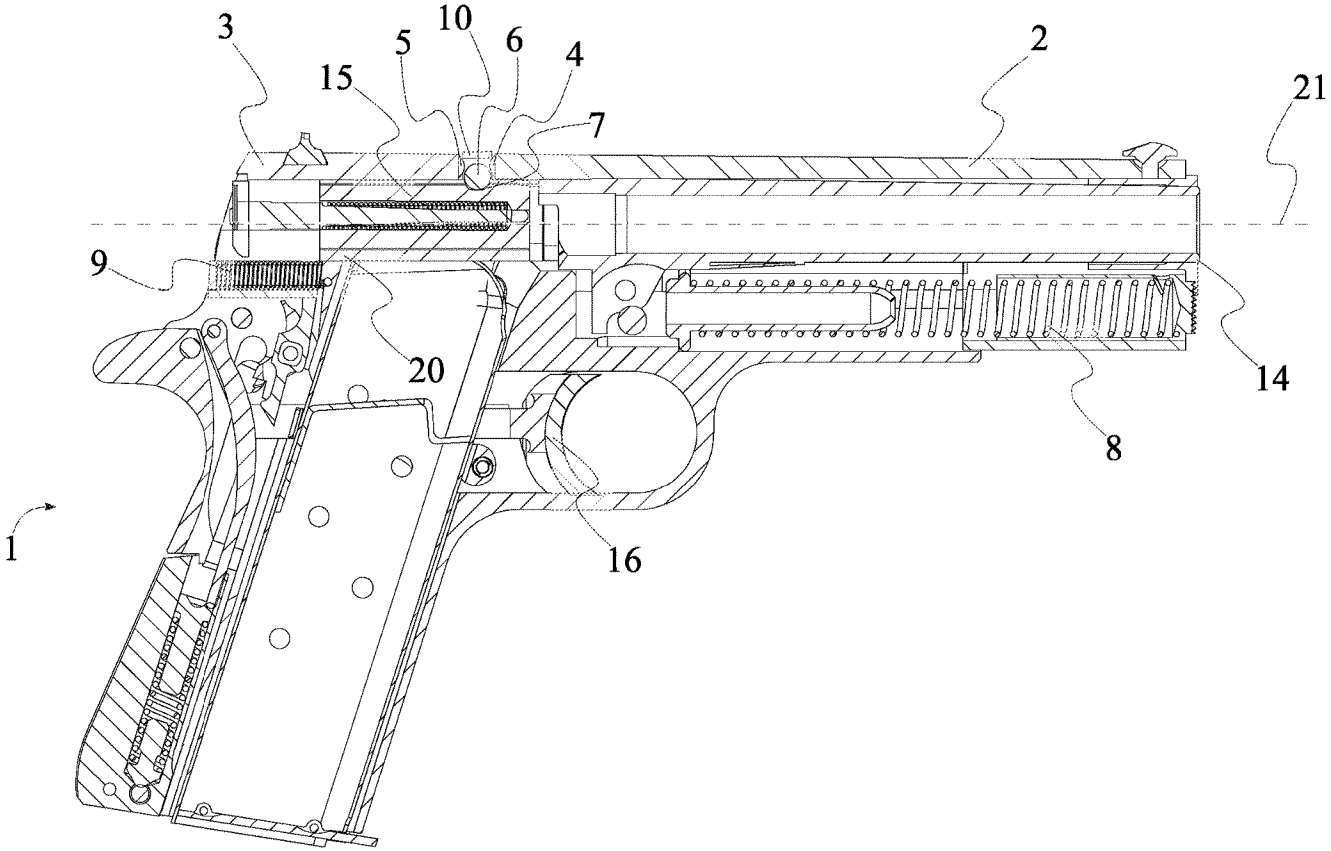
FIG. 4 is a side cross-sectional view of the present invention along the line A-A from FIG. 3, wherein the present invention is the pre-fired configuration.

For an alternate embodiment of the present invention, the present invention comprises a first compression spring 8 and a second compression spring 9, detailed in FIG. 4. The first compression spring 8 resets the position of the first slide weight 2 after dispersing the recoil force when the firearm 1 is discharged. The first compression spring 8 is connected between the first slide weight 2 and the frame 13. The first compression spring 8 is oppositely positioned to the first recoil contact 4 about the barrel 14. The first compression spring 8 is oriented parallel to the barrel 14 to allow the first compression spring 8 to translate the first slide weight 2 along the barrel 14. Similarly, the second compression spring 9 resets the position of the second slide weight 3 after dispersing the recoil force when the firearm 1 is discharged. The second compression spring 9 is connected between the second slide weight 3 and the frame 13. The second compression spring 9 is oppositely positioned to the second recoil contact 5 about the bolt carrier 15. The second compression spring 9 is oriented parallel to the barrel 14 to allow the second compression spring 9 to translate the second slide weight 3 on the frame 13 similar to the first slide weight 2.

Further in accordance to the preferred embodiment of the present invention, the present invention comprises a recoil actuator restraint 10. The recoil actuator restraint 10 prevents the recoil transfer actuator 6 from being dislodged from the present invention as the bolt 20 is depressed. The recoil actuator restraint 10 is adjacently connected to the bolt carrier 15. The recoil actuator restraint 10 is adjacently positioned with the recoil transfer actuator 6 to prevent the recoil transfer actuator 6 from being dislodged. The recoil actuator restraint 10 radially limits distance that the recoil transfer actuator 6 is able to be offset from the bolt 20. The first recoil contact 4 and the second recoil contact 5 traverse into the recoil actuator restraint 10 while the present invention is in a pre-fired configuration. Therefore, the recoil actuator restraint 10 allows the recoil transfer actuator 6 to consistently impact the first recoil contact 4 and the second recoil contact 5 each time the firearm 1 is discharged.

Still in accordance to the preferred embodiment of the present invention, the present invention comprises a bolt carrier lock 11 and a bolt carrier lock receiver 12. The bolt carrier lock 11 and the bolt carrier lock receiver 12 are a timing mechanism that momentarily secures the bolt carrier 15 to allow a majority of the explosive force from igniting the ammunition to be transferred to the projectile until the projectile exits the barrel 14. The bolt carrier lock 11 is pivotably connected to the frame 13. The bolt carrier lock receiver 12 is externally integrated with the bolt carrier 15. When the present invention is in a pre-fired configuration, the bolt carrier lock receiver 12 is adjacently positioned to the bolt carrier lock 11. The bolt carrier lock 11 selectively engages the bolt carrier lock receiver 12 to prevent the bolt carrier 15 and the second slide weight 3 from moving due to the initial force of the ignition. As the first slide weight 2 is fully extended, the bolt carrier lock 11 disengages the bolt carrier lock receiver 12 to allow the second slide weight 3 to translate away from the discharge end of the barrel 14. Thus, the spent cartridge is able to be ejected from the firearm 1 and another ammunition round is loaded a chamber of the firearm 1. The bolt carrier lock 11 diametrically opposes the first recoil contact 4 about the barrel 14. Similarly, the bolt carrier lock receiver 12 diametrically opposes the second recoil contact 5 about the bolt carrier 15. This configuration prevents the interference from the bolt carrier lock 11 and the bolt carrier lock receiver 12 with the ejection of the spent cartridge.

The first slide weight 2 is preferred to comprise a first slide engagement portion 17, a second slide engagement portion 18 and a bridging portion 19. The first slide engagement portion 17 and the second slide engagement portion 18 slideably engage the frame 13 to allow the first slide weight 2 to translate along the central axis 21. The bridging portion 19 provides structural support to the first slide weight 2. The first slide engagement portion 17 is perpendicularly connected to the bridging portion 19. Similarly, the second slide engagement portion 18 is perpendicularly connected to the bridging portion 19. The first slide engagement portion 17 and the second slide engagement portion 18 are oriented in the same direction. The barrel 14 is positioned between the first slide engagement portion 17 and the second slide engagement portion 18. The first recoil contact 4 is adjacently connected to the bridging portion 19 to allow the first recoil contact 4 to interface with recoil transfer actuator 6.

Similarly, the second slide weight 3 also comprises a first slide engagement portion 17, a second slide engagement portion 18 and a bridging portion 19. The first slide engagement portion 17 and the second slide engagement portion 18 slideably engage the frame 13 to allow the first slide weight 2 to translate along the central axis 21. The bridging portion 19 provides structural support to the second slide weight 3. The first slide engagement portion 17 is perpendicularly connected to the bridging portion 19. Similarly, the second slide engagement portion 18 is perpendicularly connected to the bridging portion 19. The first slide engagement portion 17 and the second slide engagement portion 18 are oriented in the same direction. The bolt carrier 15 is positioned between the first slide engagement portion 17 and the second slide engagement portion 18 of the second slide weight 3. The second recoil contact 5 is adjacently connected to the bridging portion 19 to allow the second recoil contact 5 to interface with recoil transfer actuator 6.

Figure 2:
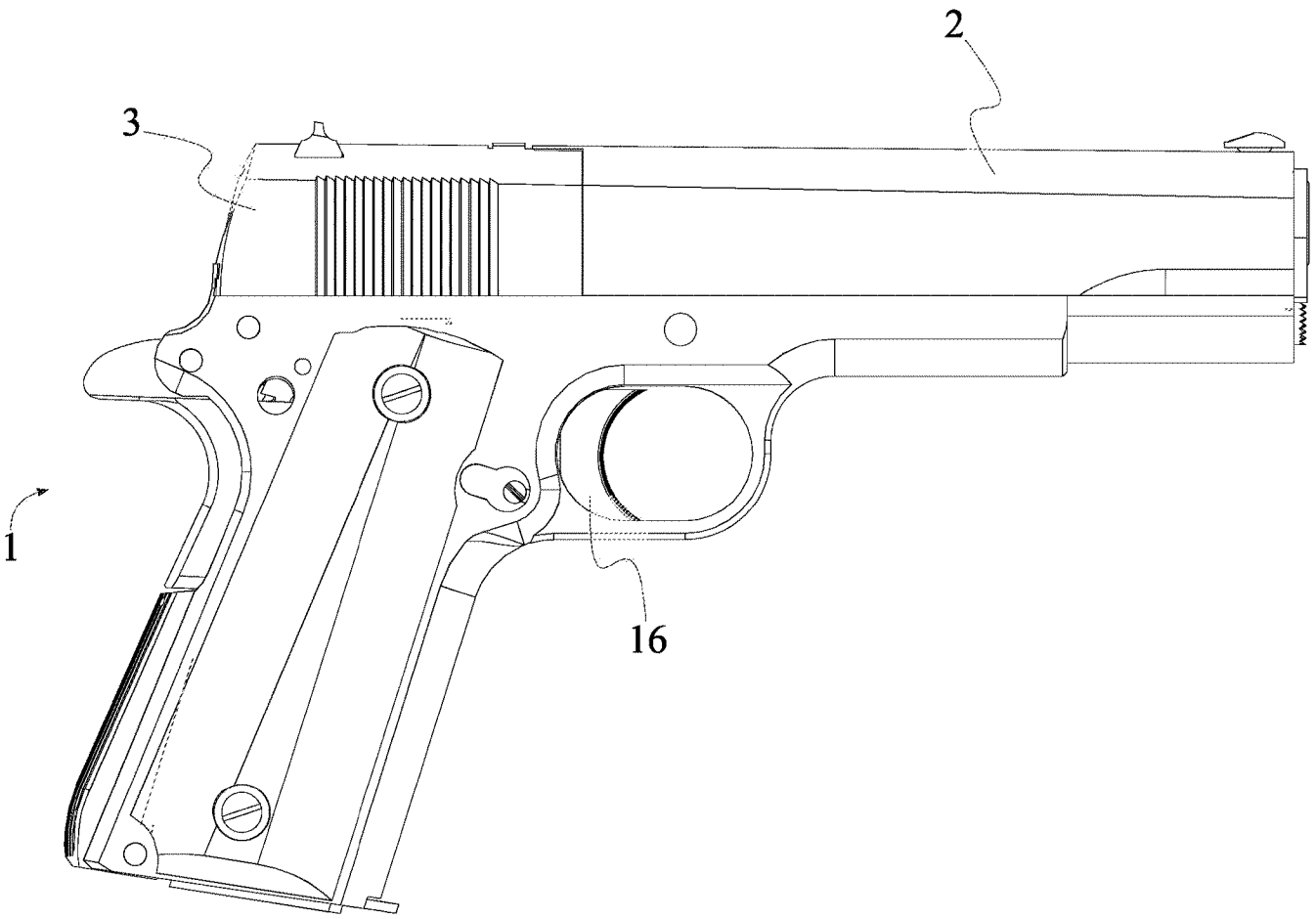
FIG. 2 is a side view of the present invention, wherein the present invention is in the pre-fired configuration.
Figure 3:
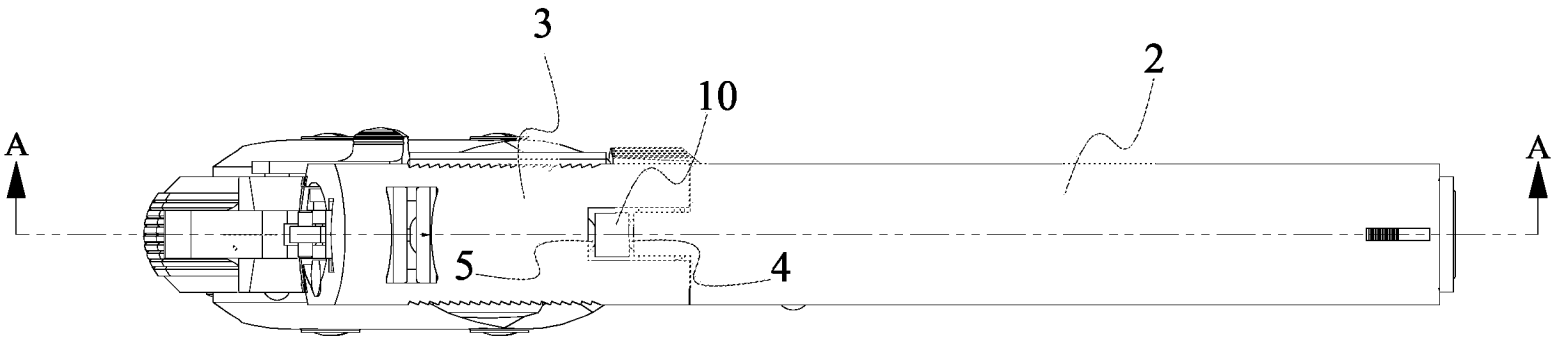
FIG. 3 is a top view of the present invention, wherein the present invention is in the fired configuration.
Figure 5:
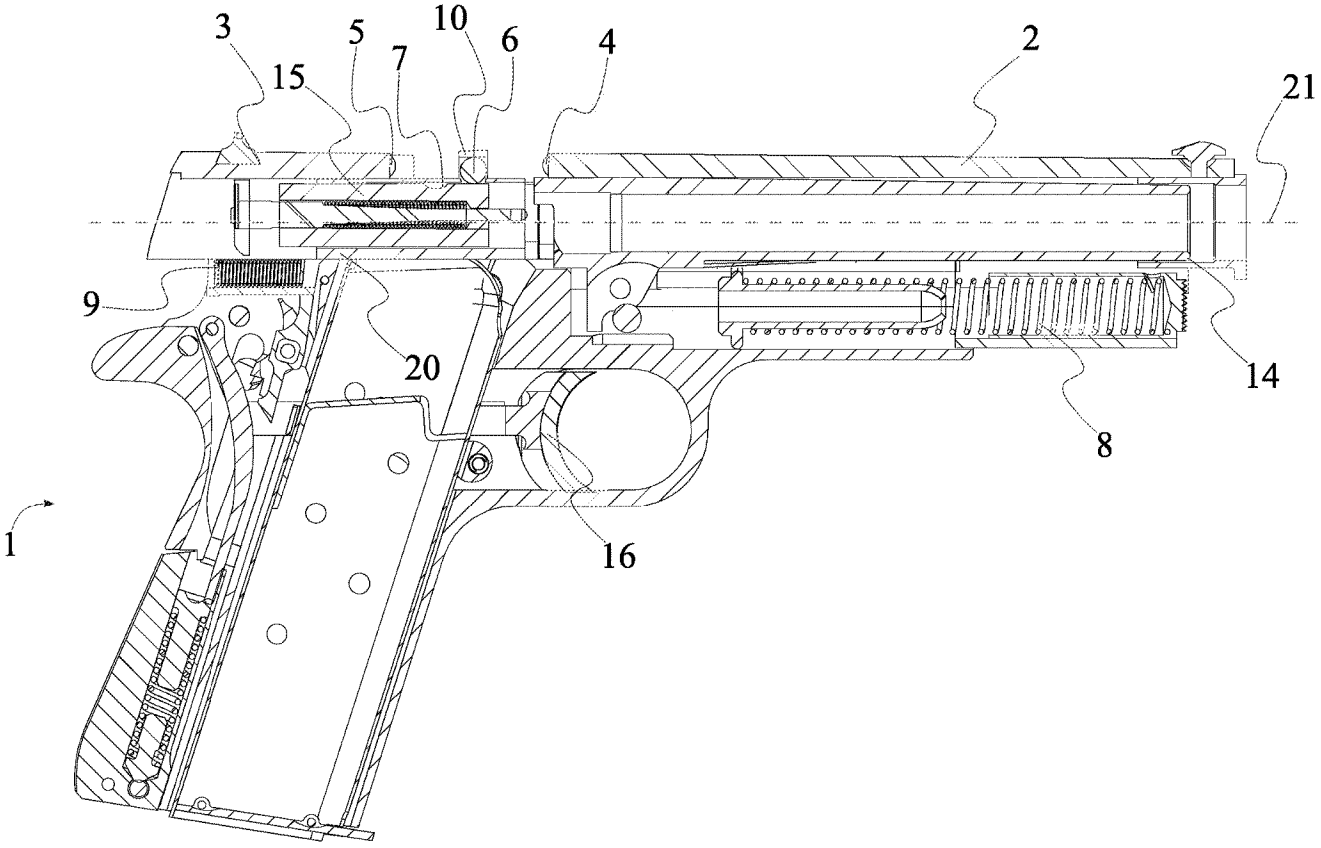
FIG. 5 is a side cross-sectional view of the present invention along the line A-A from FIG. 3, wherein the present invention is the fired configuration.

The present invention defaults in the pre-fired configuration, shown in FIG. 2 to FIG. 4. The pre-fired configuration is the configuration where the firearm 1 is ready to discharge an ammunition round. In the pre-fired configuration, the first recoil contact 4 is adjacently positioned with the recoil transfer actuator 6. The second recoil contact 5 is adjacently positioned with the recoil transfer actuator 6. The recoil transfer actuator 6 is seated within the actuation groove 7. In this configuration, the recoil transfer actuator 6 is positioned to impact the first recoil contact 4 and the second recoil contact 5 as the combustion reaction occurs to discharge the firearm 1. The expansion of the propellant within an ammunition round transitions the present invention from the pre-fired configuration into a fired configuration. After the user actuates the trigger 16 to ignite the ammunition round, the present invention is then configured in the fired configuration, shown in FIG. 1, as the projectile leaves the barrel 14. In the fired configuration, the first recoil contact 4 is offset from the recoil transfer actuator 6; the second recoil contact 5 is offset from the recoil transfer actuator 6; and the recoil transfer actuator 6 is adjacently positioned to the bolt 20, within the recoil actuator restraint 10, detailed in FIG. 5. In the fired configuration an opening is created between the first slide weight 2 and the second slide weight 3 to allow for the ejection of the spent cartridge. In the preferred embodiment, the first compression spring 8 reverts the present invention from the fired configuration to the pre-fired configuration and load the next ammunition round from the magazine into the chamber of the firearm 1. The firearm 1 is then ready to be discharged again when the user actuates the trigger 16 of the firearm 1, while ammunition rounds remain in the magazine.

Although the invention has been explained in relation to its preferred embodiment, it is to be understood that many other possible modifications and variations can be made without departing from the spirit and scope of the invention as hereinafter claimed.

What is claimed is:

1. A firearm recoil system comprises:
a firearm;
a first slide weight;
a second slide weight;
a first recoil contact;
a second recoil contact;
a recoil transfer actuator;
an actuation groove;
the first slide weight slideably engaging a frame of the firearm;
the first slide weight being slotted over a barrel of the firearm;
the second slide weight slideably engaging the frame;
the second slide weight being slotted over a bolt carrier of the firearm;
the first recoil contact being adjacently connected to the first slide weight;
the second recoil contact being adjacently connected to the second slide weight;
the actuation groove traversing into a bolt of the bolt carrier;
the actuation groove being diametrically opposed with a trigger of the firearm, about the bolt;
the recoil transfer actuator being selectively seated within the actuation groove; and
the recoil transfer actuator being positioned between the first recoil contact and the second recoil contact.

2. The firearm recoil system, as claimed in claim 1, comprises:
a first compression spring;
the first compression spring being terminally connected to the first slide weight;
the first compression spring being terminally connected to the second slide weight; and
the first slide weight being oppositely positioned with the second slide weight along the first compression spring.

3. The firearm recoil system, as claimed in claim 1, comprises:
a first compression spring;
the first compression spring being adjacently connected between the first slide weight and the frame; and
the first compression spring being oppositely positioned to the first recoil contact about the barrel.

4. The firearm recoil system, as claimed in claim 1, comprises:
a second compression spring;
the second compression spring being adjacently connected between the second slide weight and the frame; and
the second compression spring being oppositely positioned to the second recoil contact about the bolt carrier.

5. The firearm recoil system, as claimed in claim 1, comprises:
a recoil actuator restraint;
the recoil actuator restraint being adjacently connected to the bolt carrier; and
the recoil actuator restraint being adjacently positioned with the recoil transfer actuator.

6. The firearm recoil system, as claimed in claim 1, wherein the first slide weight is slideably engaged with the frame along a central axis of the barrel.

7. The firearm recoil system, as claimed in claim 1, wherein the second slide weight is slideably engaged with the frame along a central axis of the barrel.

8. The firearm recoil system, as claimed in claim 1, comprises:
the first slide weight comprises a first slide engagement portion, a second slide engagement portion, and a bridging portion;
the first slide engagement portion being perpendicularly connected to the bridging portion;
the second slide engagement portion being perpendicularly connected to the bridging portion;
the first slide engagement portion being oppositely positioned to the second slide engagement across the bridging portion;
the first recoil contact being adjacently connected to the bridging portion;
the first slide engagement portion and the second slide engagement portion being oriented in the same direction; and
the barrel being positioned between the first slide engagement portion and the second slide engagement portion.

9. The firearm recoil system, as claimed in claim 1, comprises:
the second slide weight comprises a first slide engagement portion, a second slide engagement portion, and a bridging portion;
the first slide engagement portion being perpendicularly connected to the bridging portion;
the second slide engagement portion being perpendicularly connected to the bridging portion;
the first slide engagement portion being oppositely positioned to the second slide engagement across the bridging portion;
the second recoil contact being adjacently connected to the bridging portion;
the first slide engagement portion and the second slide engagement portion being oriented in the same direction; and
the bolt carrier being positioned between the first slide engagement portion and the second slide engagement portion.

10. The firearm recoil system, as claimed in claim 1, comprises:
wherein the firearm recoil system is in a pre-fired configuration;
the first recoil contact being adjacently positioned with the recoil transfer actuator;
the second recoil contact being adjacently positioned with the recoil transfer actuator; and
the recoil transfer actuator being seated within the actuation groove.

11. The firearm recoil system, as claimed in claim 1, comprises:
wherein the firearm recoil system is in a fired configuration;
the first recoil contact being offset from the recoil transfer actuator;
the second recoil contact being offset from the recoil transfer actuator; and the recoil transfer actuator being adjacently positioned with the bolt.

* * * * *